United States Patent [19]

Atherton

[11] Patent Number: 4,529,956

[45] Date of Patent: Jul. 16, 1985

[54] COMBINED TRANSFORMER AND VARIABLE INDUCTOR

[75] Inventor: Jay W. Atherton, Seattle, Wash.

[73] Assignee: Honeywell Inc., Minneapolis, Minn.

[21] Appl. No.: 641,227

[22] Filed: Aug. 16, 1984

[51] Int. Cl.[3] ..... H01F 21/06

[52] U.S. Cl. ..... 336/83; 336/134; 336/136

[58] Field of Search ..... 336/83, 132, 134, 135, 336/136, 160, 165, 133

[56] References Cited

U.S. PATENT DOCUMENTS

| | | | |
|---|---|---|---|
| 2,567,394 | 9/1951 | Nuttman | 336/83 |
| 3,454,854 | 7/1969 | Booth | 336/83 X |
| 3,480,896 | 11/1969 | Neuman | 336/136 X |

*Primary Examiner*—Thomas J. Kozma
*Attorney, Agent, or Firm*—George W. Field

[57] ABSTRACT

A pot-core transformer with a magnetic shunt variable to add the function of a variable series inductor independent of the transformer.

4 Claims, 3 Drawing Figures

COMBINED TRANSFORMER AND VARIABLE INDUCTOR

TECHNICAL FIELD

This invention relates to the field of electrical engineering, and particularly to the design of transformers and inductance devices. It comprises an improvement on the invention disclosed in a co-pending application of C. S. Walker, Ser. No. 422,331, filed Sept. 23, 1982, and assigned to the assignee of the present invention.

BACKGROUND OF THE INVENTION

An important goal in present day design of electrical equipment is reduction in size: even when actual miniaturization is not attempted, space and volume reduction is considered desirable. One way to accomplish such reduction is to combine the functions in a single device structure.

BRIEF SUMMARY OF THE INVENTION

The present invention comprises an arrangement for combining in a single structure the functions of a transformer and a variable inductor.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals identify corresponding elements throughout the several views.

DESCRIPTION OF THE PREFERRED EMBODIMENT

Figure 1:
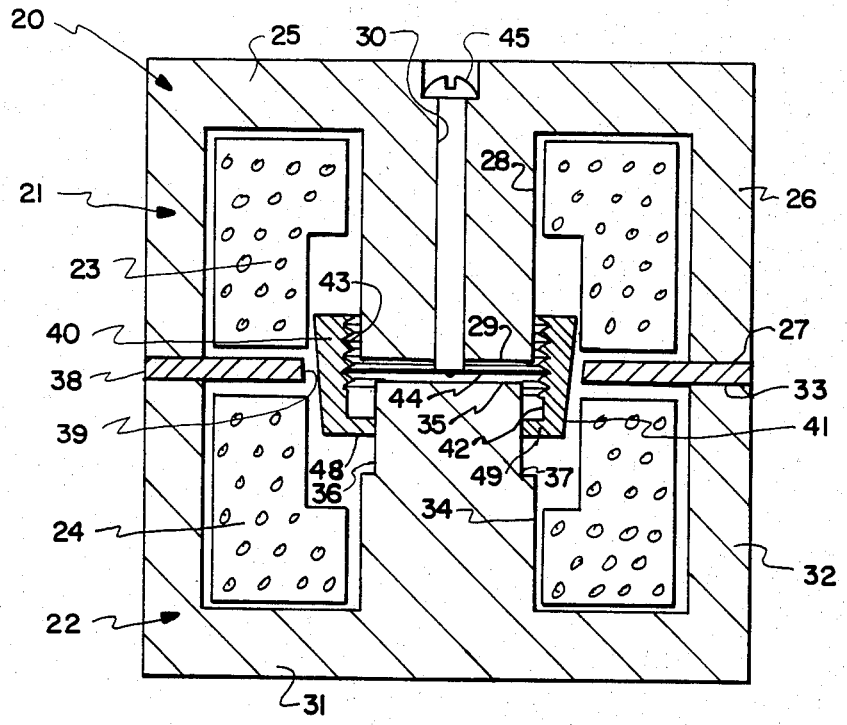
FIG. 1 is a view in axial section of an inductance device according to the invention.
Figure 2:
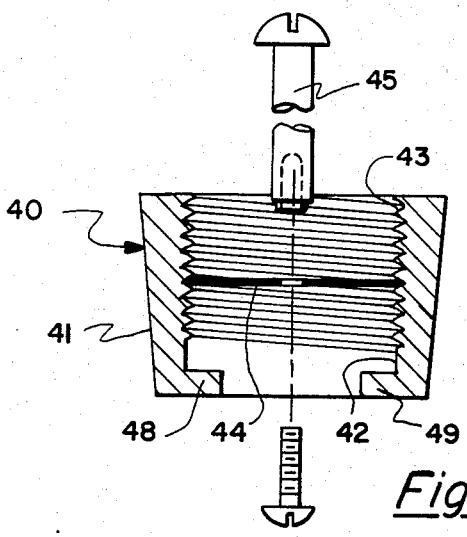
FIG. 2 is a fragmentary view showing details.
Figure 3:
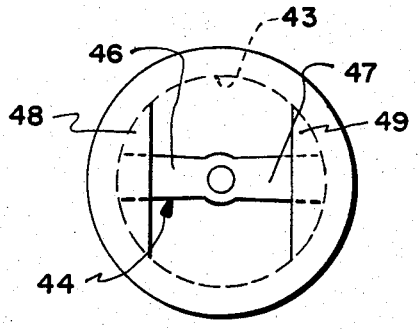
FIG. 3 is a bottom view showing a modification of FIG. 2.

The invention comprises modification of a "pot-core" transformer to add the function of an additional variable inductance without changing the characteristics of the device as the transformer.

The drawing shows a transformer of the pot-core type, which comprises a bi-partite housing 20 including two hollow, coaxial, generally cylindrical sections 21 and 22 of ferrite or other material of high magnetic permeability, which contain windings 23 and 24 respectively.

Housing portion 21 comprises an end wall or base 25 from which a peripheral wall 26 extends axially to a rim 27, and from which a central pedestal 28 extends axially in the same direction to a surface 29. Pedestal 28 is traversed by an axial bore 30. Housing portion 22 comprises an end wall or base 31 from which a peripheral wall 32 extends axially to a rim 33 in apposition with rim 27, and from which a central pedestal 34 extends axially in the same direction to a surface 35, in apposition with surface 29. Pedestal 34 has a pair of flattened surfaces 36 and 37.

Interposed between and engaged by rims 27 and 33 is a plate or disc 38 of material of high magnetic permeability having a central aperture 39 of greater size than pedestals 28 and 34, so that the apposed pedestal surfaces are spaced axially by at least a thickness of plate 38.

A hollow wedge member 40 of material of high magnetic permeability has a conical outer surface 41 and a cylindrical inner surface 42 with internal threads 43. Wedge 40 is moveable axially in the space between pedestals 28 and 34 and the aperture 39 in plate 46, to vary the air gap therebetween. This movement is accomplished by a drive member 44 carried on an adjustment control 45 in bore 30. Member 44 may comprise an externally threaded thin disc, or a pair of radial arms 46 and 47 configured to engage the threads in the wedge. Rotation of wedge member 40 is prevented by a pair of inwardly extending lips 48 and 49 which slide along pedestal surfaces 36 and 37.

OPERATION

As pointed out in the co-pending application referred to above, disc 38 provides a flux path which does not link windings 23 and 24, and as a result, has the same effect as an inductor in series with whichever winding of the transformer is the primary winding. The flux path referred to is entirely in magnetic material except for the "air gap" between the pedestals and the disc aperture. As wedge member 40 moves axially in this air gap by operation of adjustment control 45, the metal of the wedge replaces more or less of the air of the gap, and this varies the inductance of the series inductor, which is accomplished without varying the flux path making the windings and hence without changing the characteristics of the transformer as a transformer.

From the above it will be evident that I have invented a structure which combines the functions of a transformer and a variable inductor in a single structural unit.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

The embodiments of the invention in which an exclusive property or right is claimed are defined as follows:

1. In combination:

a pot-core transformer comprising a housing, of high magnetic permeability material, having an axis and including first and second hollow sections each containing at least one winding and having a base, a peripheral wall extending axially from said base to a rim, and an axial pedestal extending through said winding from said base to a surface within said wall, said rims and said surface being severally in apposition and said surfaces being mutually spaced axially;

a plate of material of high magnetic permeability in said housing positioned axially between said windings, and having a periphery apposed to at least one of said rims and a central aperture sized to define with at least one of said pedestals an annular space;

a hollow member of material of high magnetic permeability and variable wall thickness surrounding said pedestals and moveable axially in said annular space to vary the air gap between said aperture and said pedestal;

and means actuable from without said housing for causing axial movement of said hollow member.

2. The combination of claim 1 in which said hollow member has a cylindrical inner surface, internally threaded along said axis, and in which the last named means comprises a driving member rotatable about said axis between said surface of said pedestals and extending radially to threadedly engage said inner surface of said hollow member, so that rotation of said disc member about said axis causes axial movement of said hollow member.

3. The combination of claim 2 further including means extending axially through one of said pedestals and connected to said driving member for causing rotation thereof.

4. The combination of claim 1 in which said plate is located between said sections and engages said rims.

* * * * *